US006550295B2

(12) United States Patent
Hübner

(10) Patent No.: US 6,550,295 B2
(45) Date of Patent: Apr. 22, 2003

(54) MODULAR EXTERNAL DOOR HANDLE UNIT, ESPECIALLY FOR VEHICLES

(75) Inventor: Raimund Hübner, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/077,187

(22) Filed: Feb. 15, 2002

(65) Prior Publication Data

US 2002/0124607 A1 Sep. 12, 2002

(30) Foreign Application Priority Data

Feb. 24, 2001 (DE) ..... 101 09 106

(51) Int. Cl.[7] ..... E05B 13/00

(52) U.S. Cl. ..... 70/208; 70/370; 70/371; 70/451; 292/336.3; 292/DIG. 31; 292/DIG. 64; 49/503

(58) Field of Search ..... 70/368, 370, 371, 70/232, DIG. 57, 208, 210, 451, 466; 292/336.3, DIG. 31, DIG. 64; 49/503

(56) References Cited

U.S. PATENT DOCUMENTS

| | | | | | |
|---|---|---|---|---|---|
| 2,040,258 | A | * | 5/1936 | Jacobi | |
| 2,610,500 | A | * | 9/1952 | Poupitch | 70/370 |
| 2,629,248 | A | * | 2/1953 | Burdick | 70/370 |
| 3,868,836 | A | * | 3/1975 | La Roche | 70/240 |
| 4,756,638 | A | * | 7/1988 | Neyret | 70/451 X |
| 5,220,816 | A | * | 6/1993 | Fish et al. | 70/214 |
| 5,987,942 | A | * | 11/1999 | Ichinose | 70/208 |
| 6,059,329 | A | * | 5/2000 | Spitzley | 292/336.3 |
| 6,141,914 | A | * | 11/2000 | Feige et al. | 70/208 X |
| 6,234,548 | B1 | * | 5/2001 | Mittelbach et al. | 292/336.3 |
| 6,401,302 | B1 | * | 6/2002 | Josserand et al. | 292/336.3 X |

FOREIGN PATENT DOCUMENTS

| | | | |
|---|---|---|---|
| DE | 2656011 | 6/1978 | |
| DE | 3030519 | * 2/1982 | 292/336.3 |
| EP | 204605 | * 12/1986 | 70/370 |
| EP | 0447818 | 9/1991 | |

* cited by examiner

*Primary Examiner*—Lloyd A. Gall
(74) *Attorney, Agent, or Firm*—Friedrich Kueffner

(57) ABSTRACT

A vehicle door handle has a support, a lock cylinder, and a handle recess unit. A lock bolt on the support has a release position, allowing mounting and demounting of the handle recess unit, and a securing position preventing demounting. The lock cylinder is bayonet-coupled in the support. A locking member locks the coupled lock cylinder, but can move from a locking into an unlocking position allowing coupling and decoupling of the lock cylinder. A cover is movable between an initial position preventing access to the lock bolt, and an end position, allowing access to the lock bolt. In the unlocking position, the locking member prevents a reversing movement of the cover; in the locking position, it allows a reversing movement. In the end position the cover prevents access to and adjustment of the locking member, but in its initial position allows access and adjustment between the unlocking and locking positions.

6 Claims, 10 Drawing Sheets

MODULAR EXTERNAL DOOR HANDLE UNIT, ESPECIALLY FOR VEHICLES

BACKGROUND OF THE INVENTION

1. Field of the Invention

The invention relates to a modular unit of an external door handle, in particular, for vehicles, comprising a support fastened on the inner side of the door and having a receptacle for a lock cylinder cooperating with the door lock, further comprising a modular handle recess unit which can be mounted, from the external side of the door and partially through a door welt penetration, in a cutout within the support, and further comprising a lock bolt accessible through a hole in the door welt, which lock bolt is moveably guided on the support, and wherein the lock bolt can be moved from a release position, in which mounting and removal of the modular handle recess unit is possible, into a securing position relative to the modular handle recess unit mounted within the support, in which demounting of the modular handle recess unit is prevented.

2. Description of the Related Art

This modular external door handle unit comprises first the support which is fastened on the inside of the door. The support has a receptacle for a lock cylinder. This modular external door handle unit however also comprises a modular handle recess unit which can be mounted from the exterior side of the door through a penetration in the door within a cutout of the support. This modular handle recess unit is locked in position after mounting by a lock bolt which is movable within the support. The actuation of the lock bolt is realized through a hole within the door welt. When mounting the modular handle recess unit, bearing parts of the handle are moved through the penetration in the door and the cutout in the support to the inner side of the door where they can cooperate, like the lock cylinder, with the door lock upon actuation. The recess of the modular unit mounted within the support covers the door penetration in the outer skin of the door.

In a known modular external door handle unit of the assignee of the instant application, the lock cylinder was always a fixed component of the support and was fastened together with the support from the inside of the door on the external skin of the door. After attachment the lock cylinder seated within the support projected from the door penetration to the external side of the door and was then integrated into the modular handle recess unit upon mounting of the modular handle recess unit from the exterior side of the door. This known modular door handle unit requires a corresponding space in the delivery state because the lock cylinder is already integrated in the support and projects unwieldily from the plate-shaped support.

In an external door handle of a different type, which has neither a support to be fastened on the inner side of the door nor a modular handle recess unit (DE 2625011 A1), it is known to couple a lock cylinder, from the inside of the door, to a handle base member, already mounted at the external side of the door, in a bayonet coupling action by insertion and rotation and to secure the lock cylinder in its mounted position by an end plate, also placed from the inner side of the door, and by a forked spring that is transversely slipped on. Mounting of the lock cylinder from the inside of the door is cumbersome. The end plate and the forked spring required for securing the lock cylinder are lose parts which may be lost and which require separate manipulation.

In a further external door handle of the latter kind (EP 0 447 818 A1) it is known to insert a lock cylinder with revolving rod connected thereto from the external side of the door into a handle base member already fastened on the door. In the inserted state, the cylinder unit is locked by a threaded pin which is accessible through a lateral hole in the door welt.

There are also pulling-type external door handles with a bearing arm on one handle end and a shaft provided for actuating the door lock at the other handle end (DE 30 30 519 B1) which are inserted from the external side of the door through two separate penetrations in the outer skin of the door into the interior of the door where a support is fastened on the inner side of the door. The support has two separate cutouts in which the pulling handle with its bearing arm and its shaft can be inserted initially from the outer side of the door. The support has also a pivot bearing location which is coupled with the bearing arm by a subsequent lateral movement of the pulling handle. In addition to the shaft of the pulling handle, space is provided in the cutout of the support for a lock cylinder which is subsequently inserted from the outer side of the door and is also transversely moved for locking it in place. This end position of the lock cylinder is secured by a threaded connection.

This known pulling handle has a space-saving delivery state and ensures a defined mounting sequence, i.e., first handle introduction and subsequently introduction of the lock cylinder which prevents erroneous assembly, but these measures are not applicable to modular external door handle units of the kind the present invention deals with.

SUMMARY OF THE INVENTION

It is an object of the present invention to develop a space-saving modular external door handle unit of the aforementioned kind which ensures a simple and secure mounting of the modular handle recess unit, on the one hand, and of the lock cylinder, on the other hand.

In accordance with the present invention, this is achieved in that the lock cylinder can be coupled subsequently, from the external side of the door, in the receptacle of the support that is already fastened on the inner side of the door in a bayonet coupling action; in that the support comprises a locking member for the lock cylinder coupled within the support; in that the locking member is accessible at the support fastened on the inner side of the door through a hole in the door welt and is adjustable between two positions, i.e., an unlocking position, in which the bayonet coupling action and bayonet decoupling action of the lock cylinder is possible, and a locking position, in which the lock cylinder coupled within the support is locked; in that a movable cover is provided on the support which can be reversed, as needed, via the hole in the door welt between two positions, i.e., an initial position in which the cover closes the access to the lock bolt on the support, and an end position, in which the cover allows access to the lock bolt; in that the locking member projects in its unlocking position into the movement path of the cover and prevents reversal of the cover in the end position but, in its locking position, it is outside of the cover movement path and allows reversal of the cover in its end position; and in that the cover in its end position covers the locking member relative to the door welt hole and prevents movement of the locking member in the unlocking position, but the cover, in its initial position, allows access to the locking member relative to the hole in the door welt and allows adjustment between its two positions.

The cover moveably supported on the support ensures that even inexperienced personnel do not mount the different components of the modular external door handle unit in the wrong sequence, which could cause functional disruptions. This is achieved because the locking member for securing the lock cylinder coupled in the support projects into the movement path of the cover on the support when it is in the unlocking position. In this case, an interaction between the locking member and the cover takes place. At the same time, the cover in this case prevents access to the lock bolt via the hole within the door welt. Accordingly, at this point in time an undesirable locking of the erroneously first-mounted modular handle recess unit in the support is in principle prevented. The mounting personnel is forced—by the way, in opposite analogy with regard to the aforementioned known pulling handle—to first couple the lock cylinder and to secure it by its locking member. Only after this has been successfully completed, the assembly worker can move the cover into its end position where the lock bolt is accessible for the modular handle recess unit. In this end position, on the other hand, the cover also covers the locking member relative to the door welt hole and prevents an accidental decoupling of the lock cylinder. After completion of mounting of the modular handle recess unit in the support, it is then possible, as is conventional, to actuate the lock bolt in order to secure the locked position of the modular handle recess unit within the support. The delivery state of the modular external door handle unit is space-saving. It is possible to supply generic supports, without lock cylinder, which can be mass-produced in large numbers inexpensively and which can be easily stored and transported. The assembly as well as the disassembly of the individual components of the modular external door handle unit are reliably fixed with regard to their sequence so that even inexperienced personnel cannot carry out incorrect mounting of the external door handle.

DESCRIPTION OF THE PREFERRED EMBODIMENTS

Figure 1:
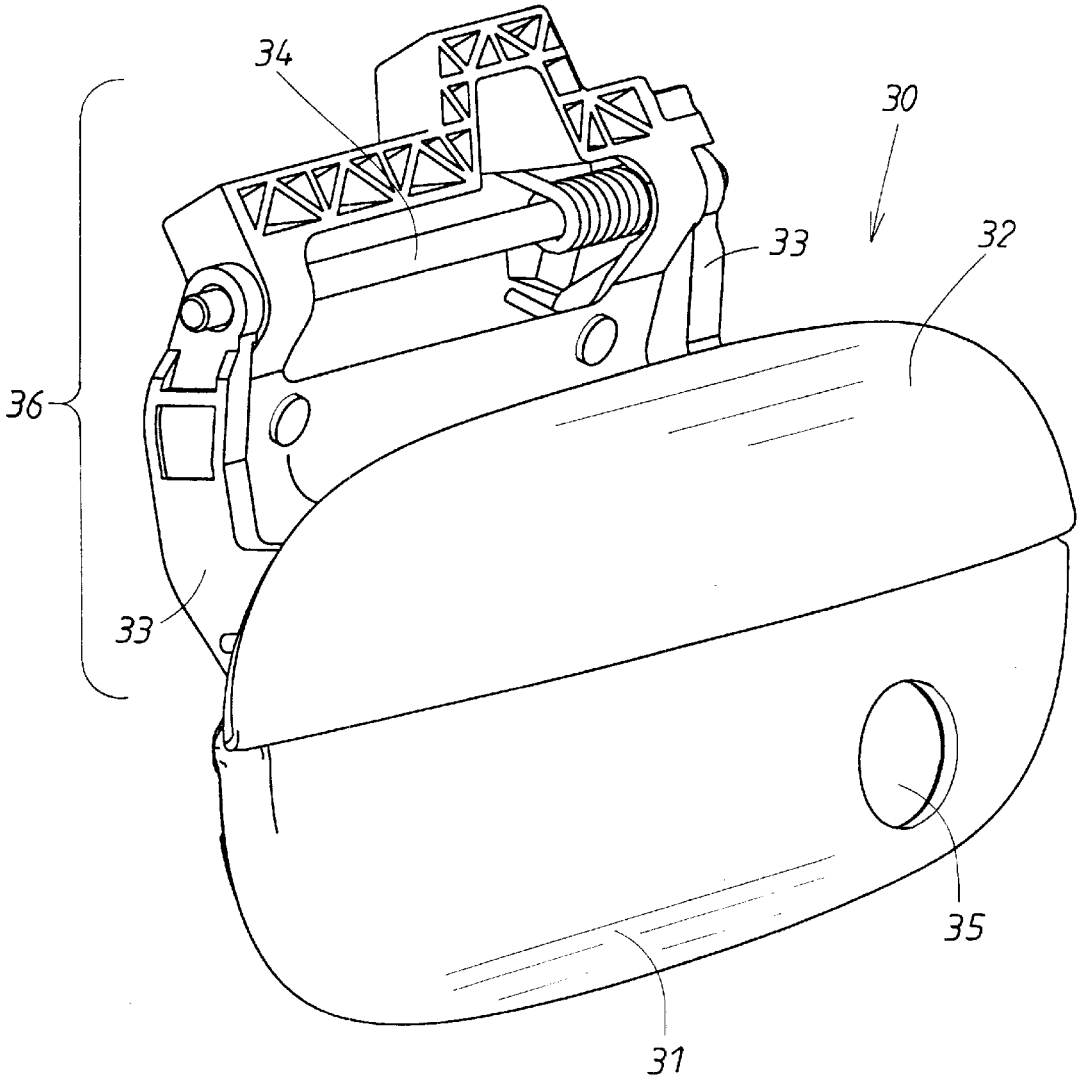
FIG. 1 shows a perspective view of a modular handle recess unit belonging to the modular external door handle unit.
Figure 2:
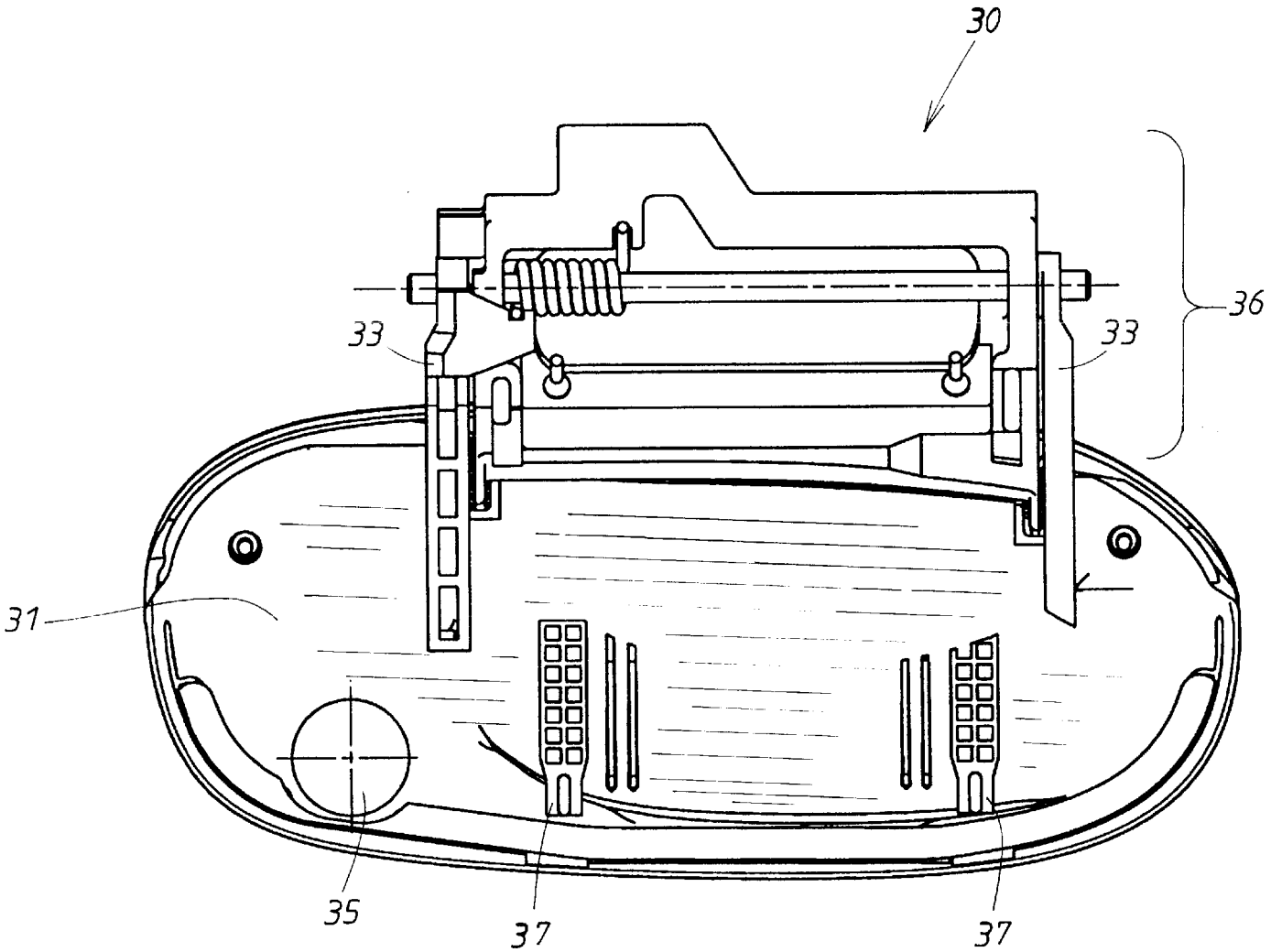
FIG. 2 is an elevation view of the backside of the modular handle recess unit of FIG. 1.

The modular external door handle unit is comprised of three separately pre-assembled parts, i.e., a support 10, a lock cylinder 20, and a modular handle recess unit 30 which will be referred to in the following as "modular recess unit" for short. The modular recess unit 30 is illustrated in FIGS. 1 and 2. It comprises a recess housing 31 with bearing arms 33 for the axle 34 of the handle 33. The recess housing 31 has also a hole 35 in which the lock cylinder 20 is positioned during mounting of the modular recess unit 30 after it has been coupled beforehand on the support 10 by a bayonet coupling action.

Figure 3:
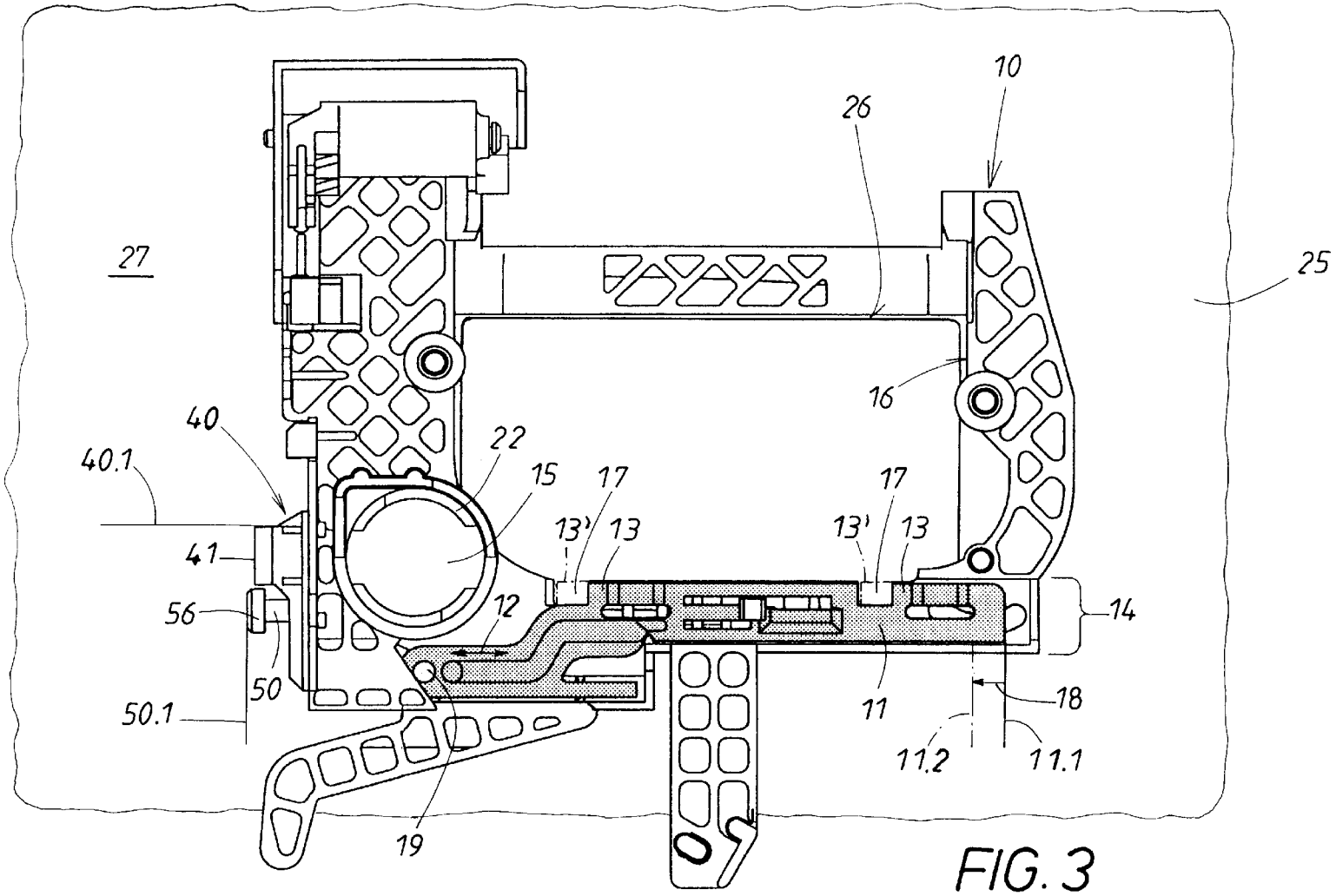
FIG. 3 shows, also in elevation, a view of the backside of a support of the modular external door handle unit.

The support with some of its elements is illustrated in FIGS. 3, 10, 11, and 12. The support 10 is first fastened from,the inner side of the door on the outer door skin 25 which is illustrated in FIG. 3 in portions in the form of its contour lines. In this area, the skin 25 has a door penetration 26 which coincides with a cutout 16 in the support. The door penetration 26 extends also across a receptacle 15 in the support which receptacle is provided for coupling the lock cylinder 20. FIG. 3 shows the inner surface 27 of the outer skin 25 and the backside of the support 10. On the support 10 a plate-shaped lock bolt 11 is guided in the direction of arrow 12 and is illustrated in the Figures by dotted hatching. In the present case, the lock bolt 12 has two lock locations 13 which are shown in solid lines in FIG. 3 and are positioned in the "release position" illustrated by auxiliary lines 11.1 of the lock bolt. In this position 11.1 the modular recess unit 30 can be mounted in the support 10, mounted at the inner side of the door, from the opposed external side of the door with the bearing means, indicated in FIGS. 1 and 2 at 36, by a straightening movement through the door penetration 26. In this connection, the support 10 cooperates with the modular recess unit 30 as follows.

Figure 8:
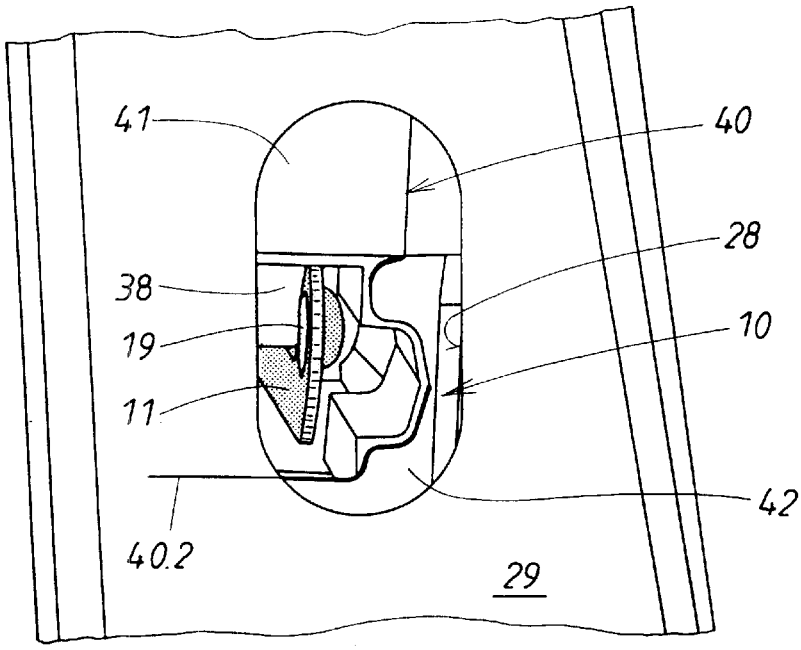
FIG. 8 shows in analogy to FIG. 6 a side view onto the door welt during the second mounting phase in a viewing direction of arrow VIII of FIG. 7.

The recess housing 31 has, as illustrated in FIG. 2, on its backside two noses 37 which during the aforementioned straightening movement pass through cutouts 17 in the frame stay 14 of the support 10. This frame stays 14 supports the lock bolt 11, and the noses 37 reach a plane positioned past the plate-shaped locking locations 13. When the lock bolt 11 is then moved by a travel stroke 18, illustrated in FIG. 3, into the securing position 11.2 illustrated by dash-dotted lines, the locking locations 13 reach the position illustrated in dash-dotted lines and identified at 13'. In the rear view of FIG. 3, the locking locations 13' engage from behind the noses 37 on the recess housing 31 in the securing position 11.2 and prevent thus demounting of the modular recess unit 30. In the securing position 11.2 the mounted position of the modular recess unit 30 is therefore secured on the external skin of the door. The actuation location 19 for the lock bolt 11 is provided in the form of a penetration in the plate-shaped lock bolt 11. This actuation location 19, as illustrated in FIG. 8, is accessible via a lateral hole 28 on the door welt 29 if this is allowed by a special cover 40.

Figure 9:
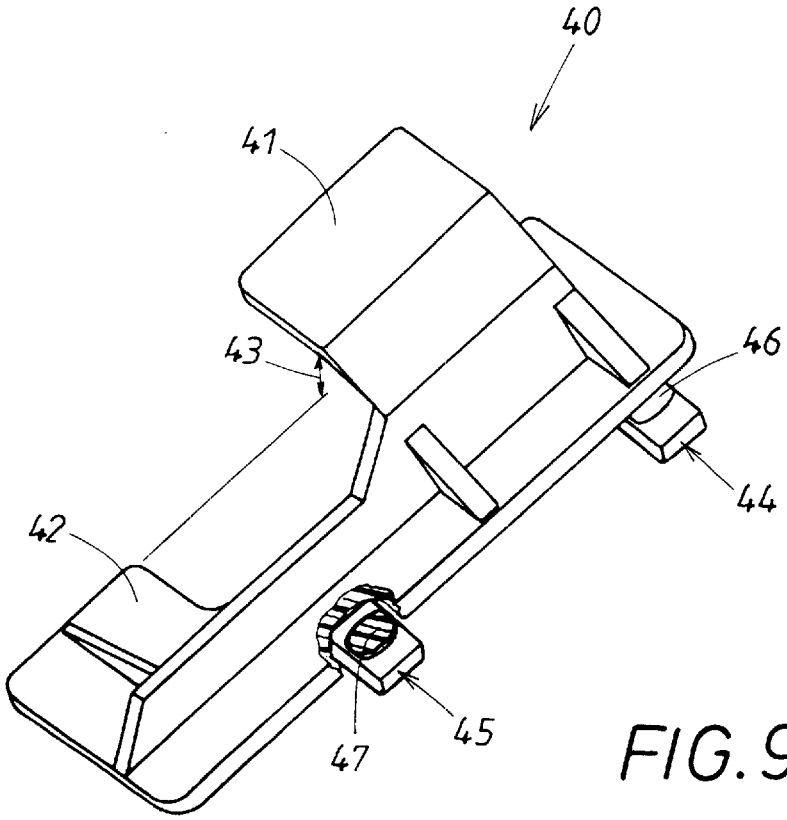
FIG. 9 shows, on a greatly enlarged scale and partially broken-away, a cover which can be partially seen within the hole of the door welt illustrated in FIG. 8.
Figure 5:
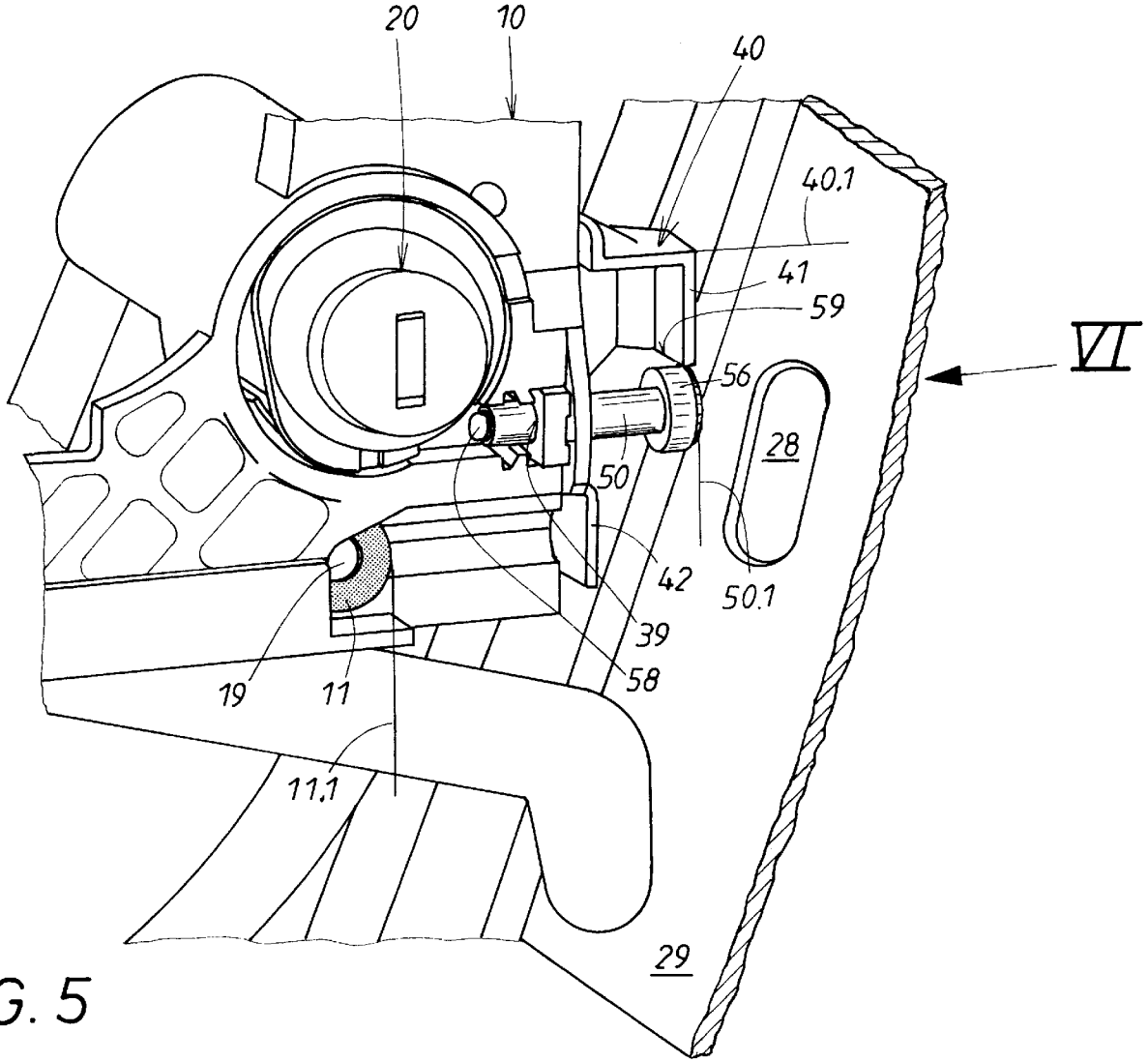
FIG. 5 is a perspective view, viewed from the external side of the door, of a first phase of mounting of a component of the modular external door handle unit, wherein—with the exception of the door welt—the external skin of the door has been omitted.
Figure 7:
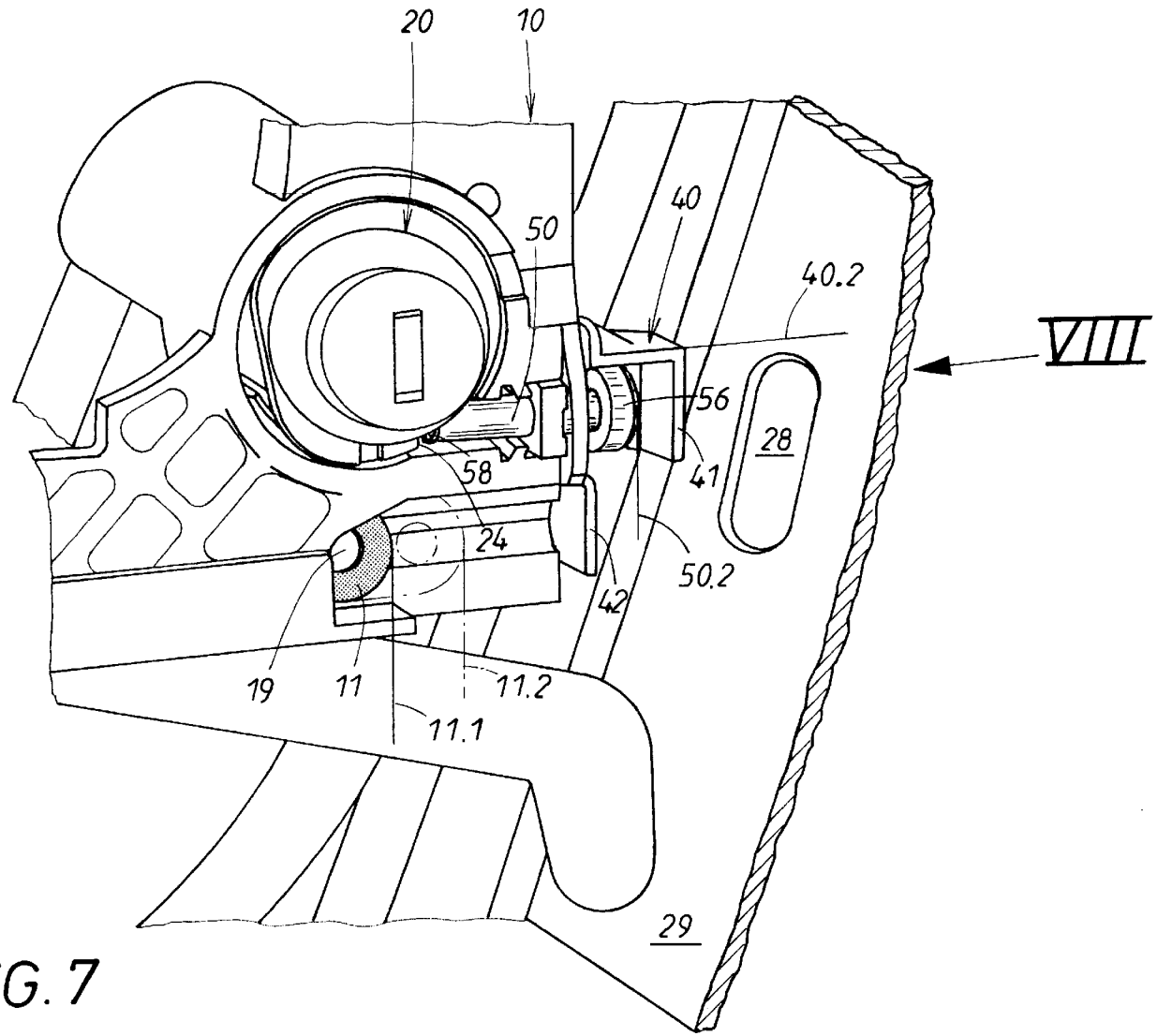
FIG. 7 shows in an illustration corresponding to FIG. 5, the component of the modular external door handle unit after completion of the second phase of mounting.
Figure 12:
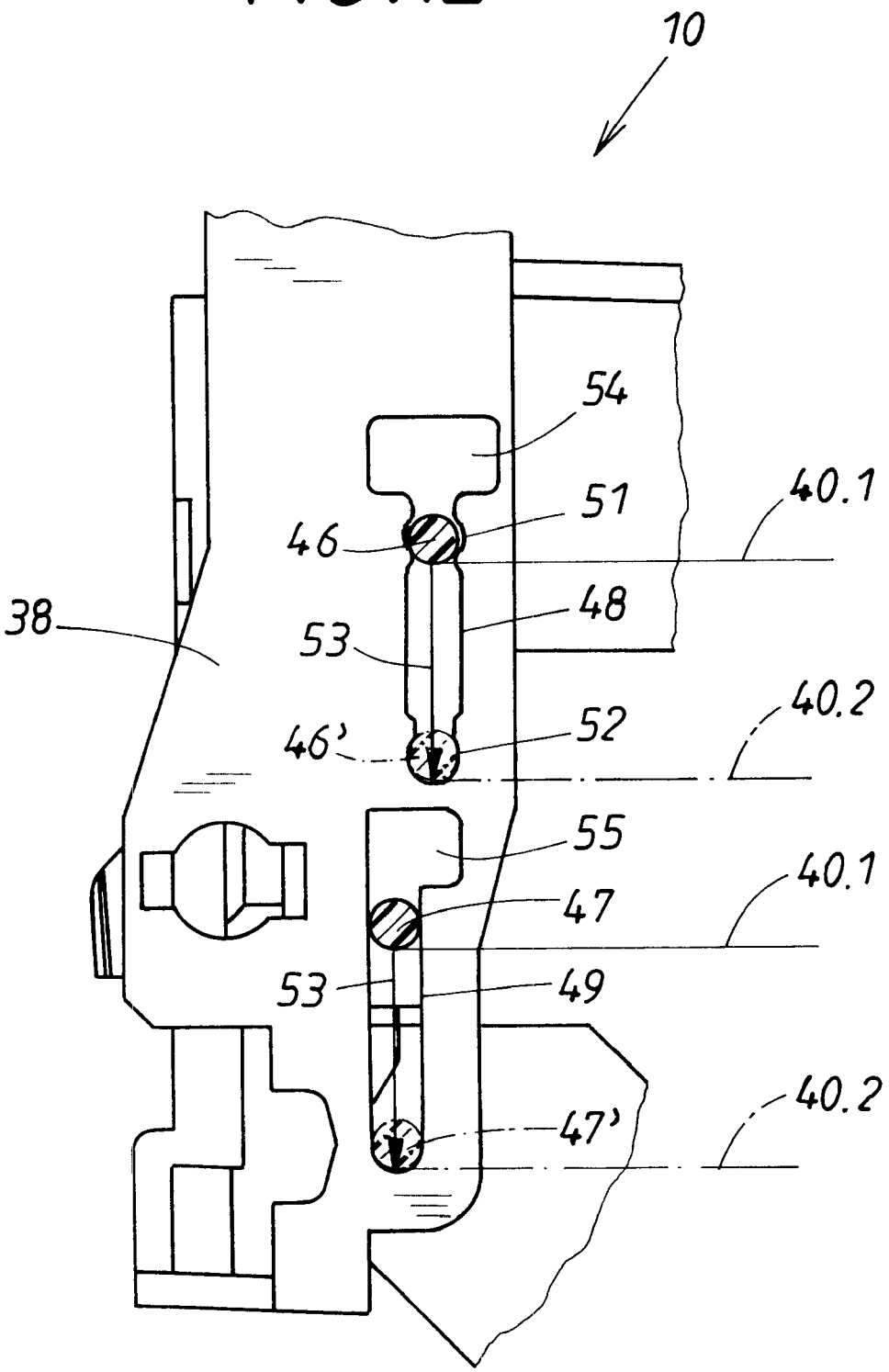
FIG. 12 shows on an enlarged scale the side view of a portion of the support illustrated in FIG. 11 in a viewing direction of arrow XII of FIG. 11 but omitting the components positioned above the section plane indicated by dash-dotted lines in FIG. 11.

The cover 40 in the present case is a slide, which is spatially (three-dimensionally) profiled as shown in FIG. 9. FIGS. 5 and 7 show that the cover 40 is guided longitudinally slidably in the area of the door welt hole 28 on the lateral narrow side 38 of the support, illustrated in FIGS. 10 through 12. The slide has two undercut legs 44, 45 which are guided by necks 46, 47 forming the undercuts, as illustrated in FIG. 12, in two slots 48, 49 on the narrow side 38 of the support. Mounting of the slide is illustrated in FIG. 10.

Figure 10:
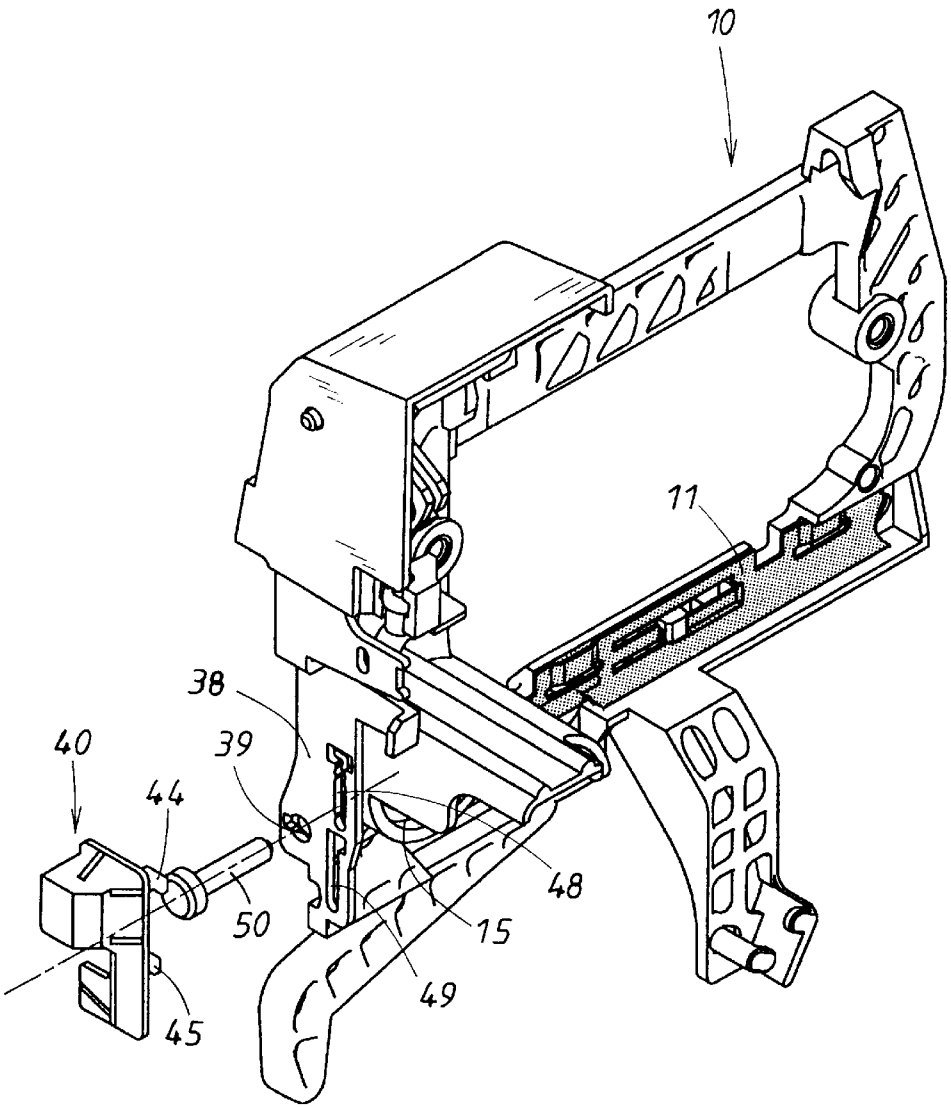
FIG. 10 shows in a perspective exploded illustration components to be laterally connected on the support.
Figure 11:
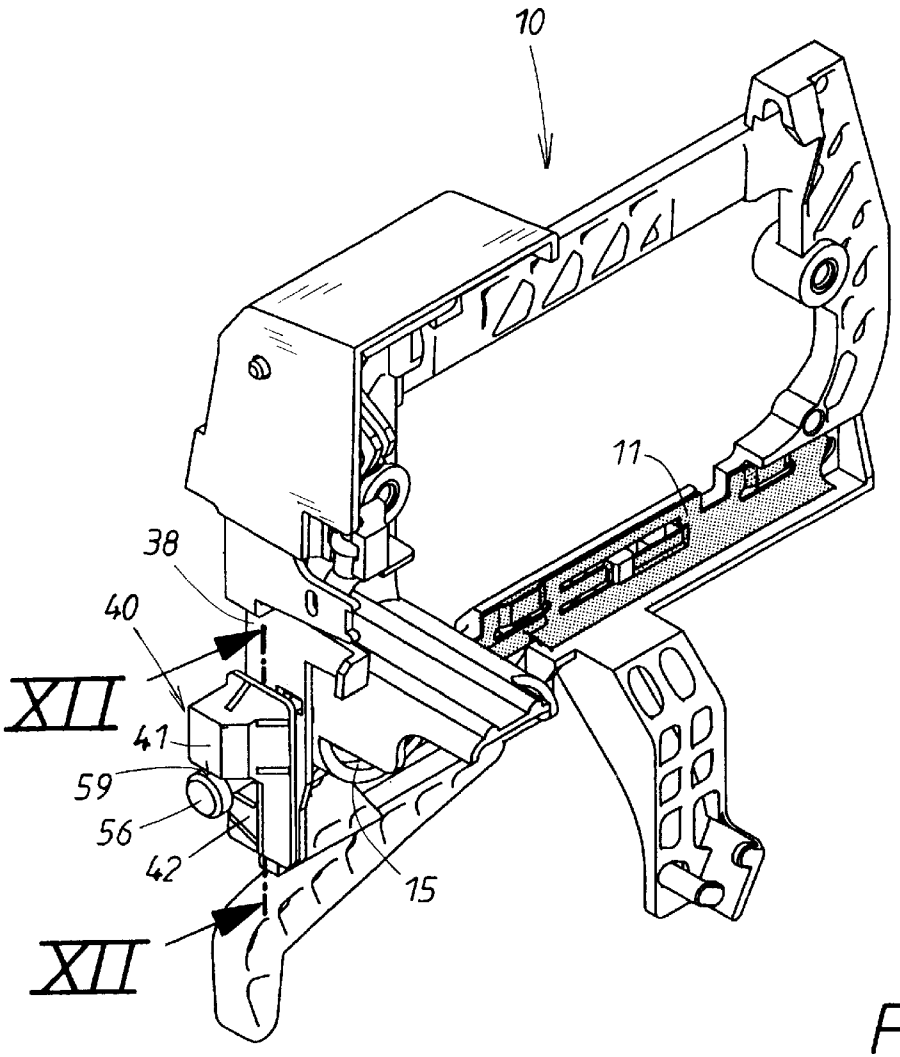
FIG. 11 shows in a perspective illustration the components attached on the support after completion of mounting.

FIG. 10 shows a perspective and exploded illustration of the support 10, of the slide 40, and the locking member 50. In this embodiment the locking member 50 is in the form of a screw. The screw 50 can be threaded into a threaded receptacle 39 which is provided in the narrow side 38 of the support. The legs 44, 45 of the slide 40 pass through. widened slot cutouts 54, 55 and the slide 40 is then moved in the direction toward the narrow slots. One slot 48 is moreover profiled in regard to its longitudinal extension relative to the cross-section of the neck 46 resting therein and has a widened slot portion 51 which defines together with the corresponding leg neck 46 a first stop for positioning the slide 40, i.e., the neck 46 and the slot portion 51 are catch means for positioning the slide. This first stop defines an "initial position" of the slide 40 which is illustrated by auxiliary line 40.1 in FIGS. 3 and 5; and this initial position has the following effects.

Figure 6:
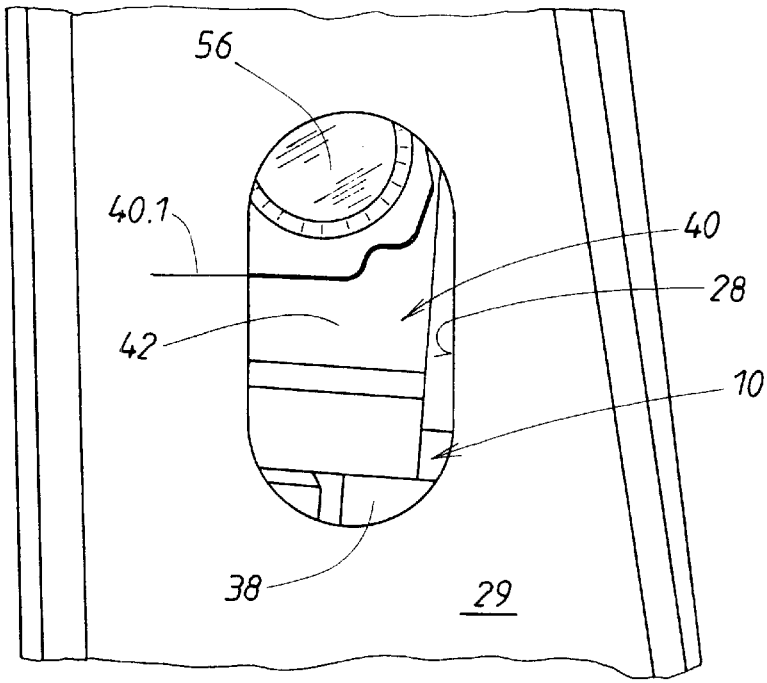
FIG. 6 shows on an enlarged scale a side view of a portion of the door welt in a viewing direction of arrow VI of FIG. 5 with a view through a hole.

As illustrated best in FIG. 9, the slide 40 has two brackets 41, 42 which are arranged at a lateral displacement but also a vertical displacement 43 relative to one another. In the initial position 40.1 of the slide 40, the second bracket 42, as shown in FIGS. 5 and 6, is in a covering position relative to the actuation location 19 of the lock bolt 11. The lock bolt 11 is then inaccessible via the door welt hole 28 and can not be moved out of its release position 11.1. Mounting and demounting of the modular recess unit 30 in the support is thus possible, as has already been explained in connection with FIG. 3.

Figure 4:
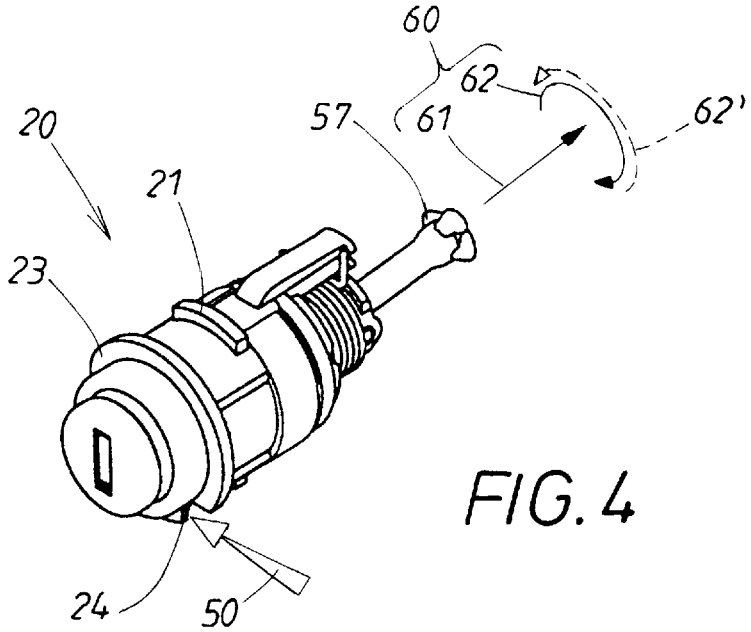
FIG. 4 is a perspective view of a lock cylinder that can be used in connection with this modular external door handle unit.

In this case, as illustrated in FIG. 6, the aforementioned locking screw 50 is easily accessible via the door welt hole 28. As illustrated in FIGS. 3 and 5, the first bracket 41 of the slide 40 collides with the actuation end 56 of the locking screw 50 and therefore cannot be adjusted in this screw position which is illustrated by the auxiliary line 50.1. In this position, as illustrated in FIG. 3, the receptacle 15 in the support is free and allows a bayonet coupling action 60 as illustrated by arrows 61, 62 in FIG. 4 or reversing decoupling, respectively, of the lock cylinder 20 in the support receptacle 15. Coupling 60 is realized in two phases 61, 62. First the lock cylinder 60 is inserted axially in the direction of arrow 61 of FIG. 4 into the support receptacle 15 which is controlled by end stops, not illustrated in detail. The lock cylinder 20 supports segments 21 which upon insertion 61 can pass the counter segments 22 illustrated in FIG. 3 which determine the profile of the receptacle 15. Then the second phase of coupling 60 occurs, in the form of the rotational movement 62 of the lock cylinder 20 as shown in FIG. 4. When this is carried out, the cylinder segments 21 move behind the counter segments 22 correlated therewith until the coupling end position of the lock cylinder 20 has been reached. Now the cylinder exit 57 is in effective connection with the door lock of the door, not illustrated in detail.

This coupling end position of the lock cylinder 20 is then secured by the locking screw 50. As can be seen in the plan view of FIG. 6 onto the external side of the door welt 29, the actuation end 56 in the initial slide position 40.1 is easily accessible via the door welt hole 28. The locking screw 50 can be turned until its shaft end 58 is positioned behind a radial shoulder 24 which, as illustrated in FIG. 4, is a component of the cylinder collar 23. Now a return movement of the lock cylinder 20 in the direction of the demounting arrow 62', illustrated as a dashed line in FIG. 4, is not possible. The lock cylinder 20 is secured in the support receptacle 15. This situation is illustrated in FIG. 7. The screw 50 is shown in a "locking position" illustrated by the auxiliary line 50.2 in FIG. 7. Accordingly, the afore described position 50.1 of the screw 50, illustrated in FIGS. 3 and 5, is the "unlocking position".

As already described, in the unlocking position 50.1 an adjustment of the slide 40 is prevented because the screw actuation end 56 projects into the movement path of the upper slide bracket 41 and collides with its stop edge 59 with the screw actuation end 56. The afore described initial position 40.1 of the slide was therefore secured by the unlocking position 50.1 of the screw 50.

When, however, the locking position 50.2 is present, the screw actuation end 56 is outside of the movement path of the upper slide bracket 41 and, therefore, a movement 53 of the slide 40, illustrated by the movement arrow 53 in FIG. 12, can take place. The slide 40 leaves the initial position 40.1, shown in dashed lines in FIG. 12, determined by the locking member 50, 56. The leg necks 46, 47 are moved within their slots 48, 49 until they reach the end position 40.2 which is illustrated in FIG. 12 in dashed lines by the auxiliary line 40.2. In this connection, the second slot 49 can be without a profile because it is sufficient when the first slot 48, as illustrated in FIG. 12, determines a second stop defining the position 50.2 by means of a further widened slot portion (catch means) 52. The end position 40.2 can also be defined by the stop action between the leg necks 46', 47' and the ends of the corresponding slots 48, 49.

The end position 40.2 of the slide 40 is illustrated in FIGS. 7 and 8. The lower slide bracket has been pushed out of the area of the door welt hole 28 and the actuation end 19 of the lock bolt is accessible for a suitable tool. Accordingly, the lock bolt 11 can be moved from the door welt 29 out of the described release position 11.1 into its securing position 11.2, as illustrated in FIG. 3, wherein, of course, also a return movement of the lock bolt in the reverse direction is possible.

In the slide end position 40.2 the upper bracket 41 of the slide 40 reaches the area of the door welt hole 28 and blocks the access to the screw actuation end 56 for a rotational tool. In the slide end position 40.2 the achieved locking position 50.2 of the screw 50 is thus ensured and the lock cylinder 20 cannot accidentally be demounted. The lock cylinder 20 is securely locked.

While specific embodiments of the invention have been shown and described in detail to illustrate the inventive principles, it will be understood that the invention may be embodied otherwise without departing from such principles.

What is claimed is:

1. A modular external door handle unit for vehicles, comprising:

a support fastened on an inner side of a vehicle door, wherein the support comprises a receptacle for a lock cylinder cooperating with a door lock and further comprises a cutout;

a modular handle recess unit configured to be mounted from the exterior side of the vehicle door partially through a door penetration in the cutout of the support;

a lock bolt moveably supported on the support and accessible through a hole in a door welt of the vehicle door;

wherein the lock bolt is configured to be moved from a release position, in which mounting and demounting of the modular handle recess unit is possible, into a securing position relative to the modular handle recess unit mounted on the support, in which securing position demounting of the modular handle recess unit is prevented;

wherein the lock cylinder is configured to be coupled, from the exterior side of the door, by a bayonet coupling action in the receptacle of the support after the support has already been fastened at the inner side of the vehicle door;

wherein the support has a locking member for locking the lock cylinder when coupled within the support;

wherein the locking member is accessible through a hole within the door welt and is movable into an unlocking position, in which coupling and decoupling of the lock cylinder is possible, and into a locking position, in which the lock cylinder coupled within the support is locked;

a movable cover provided on the support and configured to be movable between an initial position, in which the cover closes off access to the lock bolt, and an end position, in which the cover allows access to the lock bolt;

wherein the locking member, when in the unlocking position, projects into the movement path of the covet and prevents a reversing movement of the cover away from the end position and, when in the locking position, is positioned outside of the movement path of the cover and allows a reversing movement of the cover away from the end position;

wherein the cover, when in the end position, covers the locking member relative to the hole in the door welt and prevents adjustment of the locking member in the unlocking position, and wherein the cover, when in its initial position, allows access to the locking member via the hole in the door welt and allows adjustment of the locking member between the unlocking position and the locking position.

2. The modular external door handle unit according to claim 1, wherein the lock bolt is longitudinally slidably arranged on the support so as to be moveable between the securing position and the release position.

3. The modular external door handle unit according to claim 1, wherein the cover is comprised of a three-dimensionally profiled slide longitudinally slidably guided on a side of the support facing the door welt hole.

4. The modular external door handle unit according to claim 1, wherein the bayonet coupling action for coupling and decoupling of the lock cylinder is comprised of an insertion movement phase and a rotational movement phase, and wherein the lock cylinder has a radial shoulder against which the locking member rests in the locking position and thus prevents a return rotation of the lock cylinder corresponding to the rotational movement phase for decoupling.

5. The modular external door handle unit according to claim 1, wherein the locking member is comprised of a screw having an actuating end facing the door welt hole, wherein the screw is screwed into a threaded receptacle of the support.

6. The modular external door handle unit according to claim 1, comprising cooperating catch means provided on the cover and the support for securing the initial position, the end position, or the initial position and the end position of the cover.

* * * * *